United States Patent [19]

Bennett

[11] 4,420,098

[45] Dec. 13, 1983

[54] BELLOWS ACTUATED FOAM DISPENSER

[76] Inventor: Robert A. Bennett, 170 Sturbridge Rd., Easton, Conn. 06425

[21] Appl. No.: 319,946

[22] Filed: Nov. 10, 1981

[51] Int. Cl.[3] ..... F04C 1/14; B65D 43/02

[52] U.S. Cl. ..... 222/190; 222/209; 222/211; 222/401

[58] Field of Search ..... 222/209, 212, 335, 211, 222/215, 401, 190, 192, 206, 394, 398

[56] References Cited

U.S. PATENT DOCUMENTS

| | | | |
|---|---|---|---|
| 3,255,933 | 6/1966 | Martin | 222/209 |
| 3,985,271 | 10/1976 | Gardner | 222/211 |
| 4,087,024 | 5/1978 | Martin et al. | 222/211 |
| 4,274,562 | 6/1981 | Medeiros et al. | 222/401 |

*Primary Examiner*—Joseph J. Rolla
*Assistant Examiner*—Michael S. Huppert

[57] ABSTRACT

A vertical container has first and second spaced apart horizontal openings and is otherwise sealed. The container has a hollow chamber communicating with the first and second openings. The chamber is adapted to be partially filled with liquid. The maximum level of fill is disposed below both openings. The region between the liquid level and the openings is air filled. A first device is secured and sealed to the first opening and includes a manually operable bellows disposed above the first opening. The bellows has compressed and released positions. A second device is secured and sealed to the second opening and includes a discharge orifice. A vertical dip tube open at both ends is disposed in the container. The top end of the tube is disposed adjacent the second opening. The bottom end of the tube is adjacent but spaced above the botton of the container. An air-liquid mixer disposed in the second opening in the region is coupled between the second means the top end of the tube. The mixer, when the bellows is in compressed position, mixes air with liquid expelled from tube to produce foam which is discharged through the orifice. Ambient air is drawn through the orifice into the region to replace the liquid expelled when the bellows returns from compressed position to released position.

5 Claims, 5 Drawing Figures

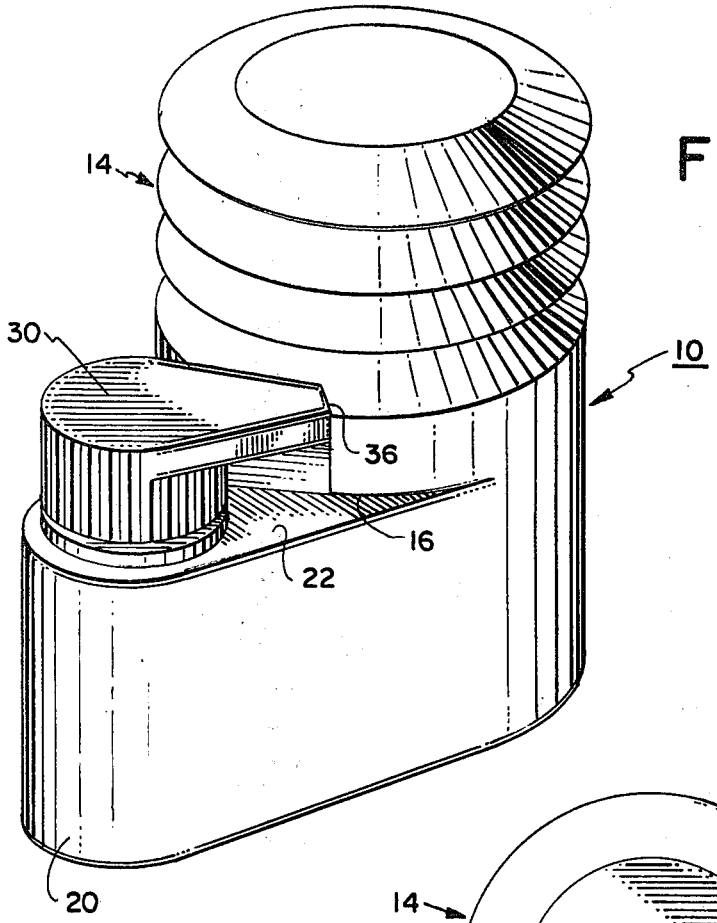
FIG. 1
FIG. 2
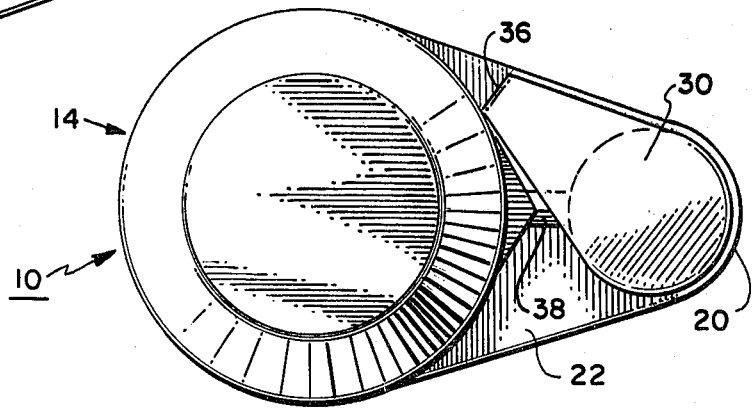

BELLOWS ACTUATED FOAM DISPENSER

BACKGROUND OF THE INVENTION

Bellows actuated dispensers are well known as shown, for example, in U.S. Pat. Nos. 3,341,083 and 3,323,689. However, such dispensers have certain inherent disadvantages. In U.S. Pat. No. 3,341,083, for example, the bellows is mounted in the side of a flexible plastic container. Since the bellows operation increases the pressure of air in the container, the portion of the container between the bellows and the container top must be free of liquid at all times, otherwise the device will not operate. Moreover, this device enables liquid in the container to be atomized and discharged as a spray, but does not produce a foam discharge. Similarly in U.S. Pat. No. 3,323,689, the bellows is disposed at the top of the container, thereby allowing a more complete liquid fill. However, the structure emloyed is relatively complex and expensive, since it utilizes a plurality of check valves, discharge and suction tubes, a valve member and the like. Moreover, this device produces a liquid discharge rather than a foam.

In contradistinction, the present invention is directed toward a new type of bellows actuated dispenser which can be more completely filled with fluid, can be manufactured less expensively, and uses fewer parts than the devices described above. Moreover, the present invention, unlike the aforesaid known devices, produces a foam discharge.

SUMMARY OF THE INVENTION

A foam dispenser in accordance with the invention employs a vertical container having first and second spaced apart horizontal openings and being otherwise sealed. The container has a hollow chamber communicating with said first and second openings. The chamber is adapted to be partially filled with liquid, the maximum level of liquid fill being disposed below both openings. The region between the liquid level and said openings is air filled.

First means secured and sealed to said first opening includes a manually operable bellows disposed above the first opening. The bellows has compressed and released positions.

Second means secured and sealed to said second opening includes a discharge orifice. Typically this second means can be manually rotated to a first position at which the orifice is open or to a second position at which the orifice is closed.

A vertical dip tube open at both ends is disposed in said container, the top end of the tube being disposed adjacent said second opening. The bottom end of the tube is adjacent but spaced above the bottom of the container.

An air-liquid mixer disposed in said second opening in said region is coupled between said second means and the top end of the tube, said mixer, when said bellows is in compressed position and the orifice is open, mixing air with liquid expelled from tube to produce foam which is discharged through said orifice. Ambient air is drawn through said orifice into the region to replace the liquid expelled when the bellows returns from compressed position to released position.

The container can take the form of a hollow vertical cylinder having the first opening disposed in the top thereof. The container can also have a side opening which extends upwardly from the bottom of the cylinder to a position adjacent but below the first opening. The remainder of the container can be constituted by a hollow body integral with the cylinder. The interior of the body communicates via the side opening into the interior of the cylinder to form the hollow chamber. The body extends outwardly from the cylinder and has a horizontal top containing the second opening. The top has a raised elongated horizontal conduit extending between the side opening and the second opening to establish an air passage between the cylinder and the body when the chamber contains liquid to be dispensed as foam and the level of liquid in the chamber is coincident with the top. If this conduit were not present when the liquid level was coincident with the top, air would not flow between the cylinder and the body and the device would not function.

BRIEF DESCRIPTION OF THE DRAWINGS

FIG. 1 is a perspective front view of the invention.
FIG. 2 is a top view thereof.

DETAILED DESCRIPTION OF PREFERRED EMBODIMENTS

Figure 4:
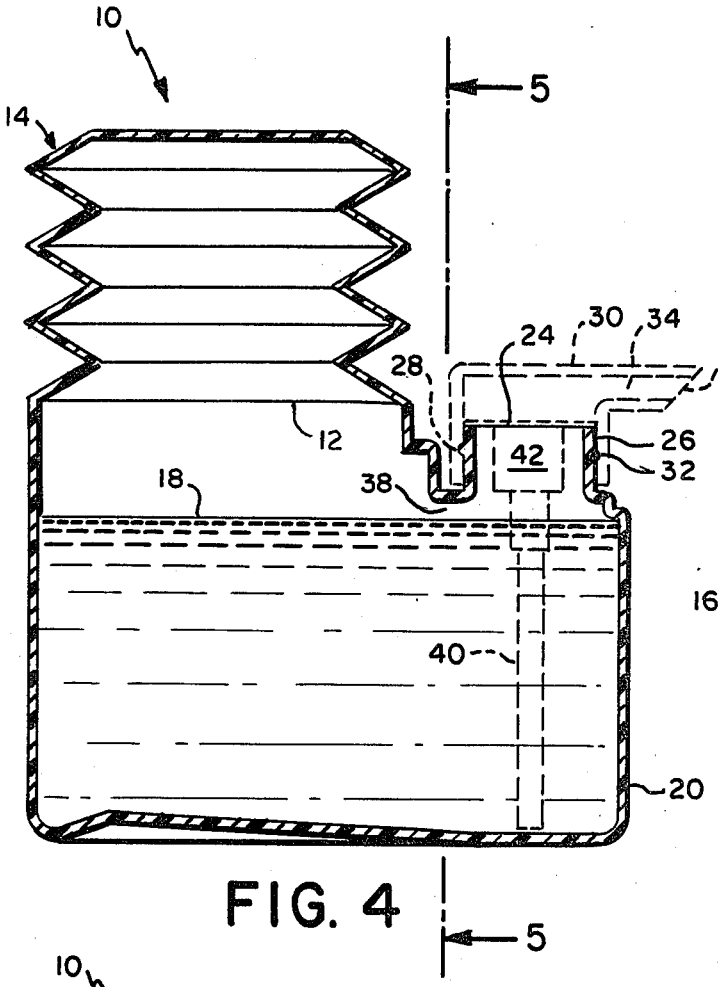
FIG. 4 is a side sectional view thereof.
Figure 5:
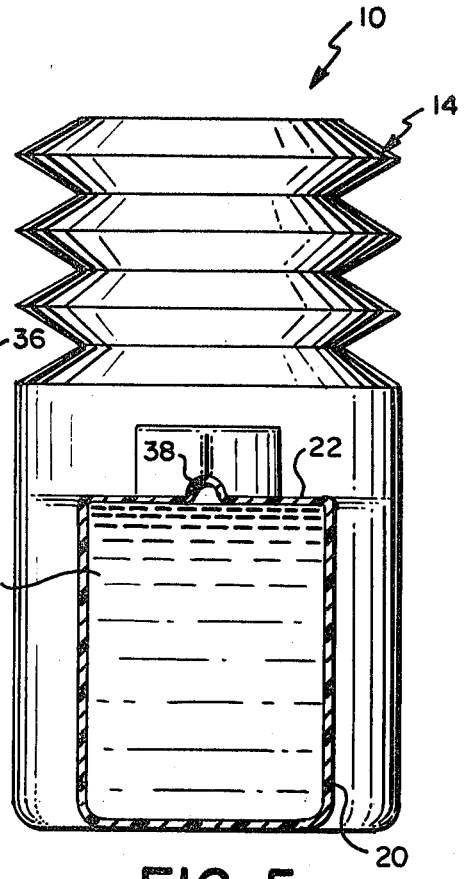
FIG. 5 is a view taken along line 5—5 in FIG. 4.
Figure 3:
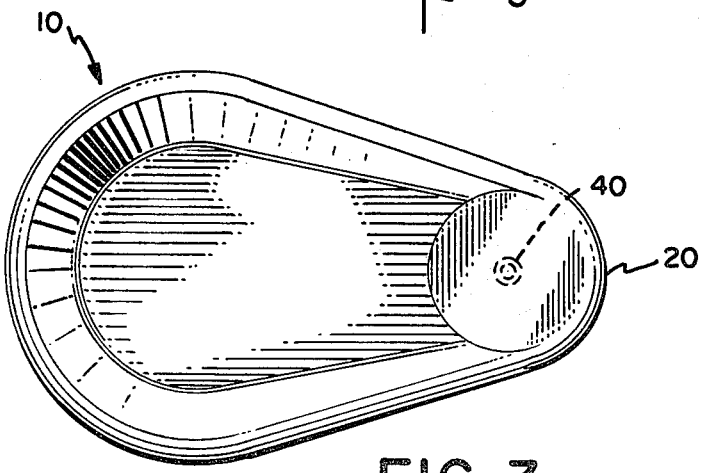
FIG. 3 is a bottom view thereof.

Referring now to FIGS. 1–5, a vertical hollow cylinder 10 has a top disposed opening 12 identified as a horizontal first opening in the claims which follow. A vertical manually operable bellows 14 is sealed to opening 12 and extends upwardly therefrom. The cylinder 10 has a side opening 16 identified as a side disposed second opening in the claims which follow which extends upwardly from the bottom of the cylinder to a position adjacent but below the top opening as shown by horizontal line 18. A hollow body 20 integral with the cylinder has an interior communicating via opening 16 into the interior of the cylinder to form a common hollow chamber.

Body 20 extends outwardly from the cylinder and has a horizontal top 22. The top 22 has a top disposed opening 24 with a neck 26. The neck carries an outer cam groove 28. A cap 30 having an inner cam follower 32 is secured rotatably to the neck. Follower 32 rides in groove 28. The cap carries a discharge conduit 34 with discharge orifice 36. When the cap is rotated so that orifice 36 points outward in a direction coincident with conduit 38 (the function of conduit 38 is described below) the orifice is open. When the cap is rotated in either direction so that the orifice points in a different direction, the orifice is closed. A more detailed description of the cap, cam follower and cam groove, discharge orifice and discharge conduit will be found in copending application Ser. No. 319,947, filed on the same day as the present application. The inventor-applicant of the present invention is the same inventor-applicant of the aforesaid copending application. The contents of the copending application are incorporated by reference herein.

A vertical hollow dip tube 40 open at both ends extends downwards in the body from the neck to a position adjacent but above the bottom. The top end of the tube connects to an air liquid mixing device or foamer 42 which is disposed within the cap and is connected to the discharge conduit 34. Various types of known foamers can be used. One such foamer is shown and described in U.S. Pat. No. 4,156,505.

Horizontal top 22 is provided with a raised elongated horizontal conduit 38 which extends between and interconnects side opening 16 and top opening 26. When the level of liquid in the chamber is raised to its maximum and is coincident with top 22, the conduit 38 provides the only path for air to pass from the cylinder into the body when the bellows is compressed and the pressure of air in the cylinder is raised.

This raised pressure, assuming that the orifice is open, causes air to flow into the foamer and also forces liquid upward through the dip tube into the foamer. The air-liquid mixture in the foamer produces the desired foam which is discharged via the orifice. When the pressure on the bellows is released and the bellows returns to normal position, air flows backwardly through the orifice discharge conduit and mixer into the chamber to replace the liquid previously discharged.

What is claimed is:

1. A foam dispenser comprising:

a hollow vertical cylinder having a top disposed horizontal first opening therein and a side disposed second opening therein which extends upward from the bottom of the cylinder to a position adjacent but below the first opening, said cylinder being otherwise sealed;

a hollow body integral with said cylinder, the interior of said body communicating via said second opening into the interior of the cylinder to form a common hollow chamber, said body extending outward from the cylinder and having a horizontal top, said top having a horizontal third opening therein, said body being otherwise sealed, said top having a raised elongated horizontal conduit extending between said second opening and said third opening to establish an air passage between said cylinder and said body when the chamber contains liquid to be dispensed and the level of the liquid in the chamber is coincident with said top;

first means including manually operable bellows secured and sealed to said first opening;

second means including a discharge orifice secured and sealed to said third opening;

a vertical dip tube open at both ends and disposed in said body, the top end of the tube being disposed adjacent said third opening, the bottom end of the tube being adjacent but spaced above the bottom of the body; and third means disposed in said third opening above the liquid level, said third means being connected to the top end of the tube and coupled to the second means whereby when the bellows is compressed liquid forced upwardly out of the tube is mixed with air in the third means to produce foam which is discharged through the orifice, ambient air being drawn through said orifice into the chamber to replace the liquid expelled when the compression force on said bellows is released.

2. The dispenser of claim 1 wherein said second means has a first position at which foam can be discharged through said orifice and a second position at which foam cannot be discharged through said orifice, said second means being manually rotatable to either one of said first and second positions.

3. The dispenser of claim 2 wherein said bellows is compressed downwardly and is released upwardly.

4. The dispenser of claim 1 wherein the third opening is horizontally offset from said first opening and said second opening, said third opening being disposed below said first opening.

5. The dispenser of claim 2 wherein a neck extends upwards from said third opening, said second means including a cam groove on the outside of the neck and a hollow cap with an inner opening through which the neck extends, the inner wall of the opening carrying a horizontal cam follower engaging the cam groove.

* * * * *